United States Patent [19]

Antos et al.

[11] Patent Number: 4,462,124

[45] Date of Patent: Jul. 31, 1984

[54] FLUSH APPARATUS FOR WATER CLOSET AND METHOD OF OPERATION

[75] Inventors: John M. Antos, Ann Arbor; Richard G. Lapham, Jackson; Charles L. Sargent, Ann Arbor, all of Mich.; Frank T. Sargent, Ft. Myers, Fla.

[73] Assignee: Thetford Corporation, Ann Arbor, Mich.

[21] Appl. No.: 232,651

[22] Filed: Feb. 9, 1981

[51] Int. Cl.[3] ..... E03D 5/00

[52] U.S. Cl. ..... 4/346; 4/364

[58] Field of Search ..... 4/345, 346, 368, 369, 4/371, 364, 340-344, 363, 421, 425, 373, 374

[56] References Cited

U.S. PATENT DOCUMENTS 407,558 7/1889 Wellington ..... 4/344

2,030,559 2/1936 Zwermann ..... 4/425 X 3,843,978 10/1974 Ragot ..... 4/425

3,984,878 10/1976 Grasseschi ..... 4/425 X 4,145,776 3/1979 Crosby et al. ..... 4/421 X

*Primary Examiner*—Charles E. Phillips

*Attorney, Agent, or Firm*—Stephenson & Boller

[57] ABSTRACT

A water closet (10) for conserving water which has a siphon jet (30) in the bowl (12) for initiating evacuation of the contents of the bowl through the trap (26), and a flush water storage tank (14) that includes chambers (68) and (72) through which water can flow in measured quantities, first to the siphon jet for initiating the siphon action, and second, to the bowl (12) for rinse purposes in a timed-delay action so that substantially no mixing of the rinse water with the contents of the bowl occurs.

11 Claims, 9 Drawing Figures

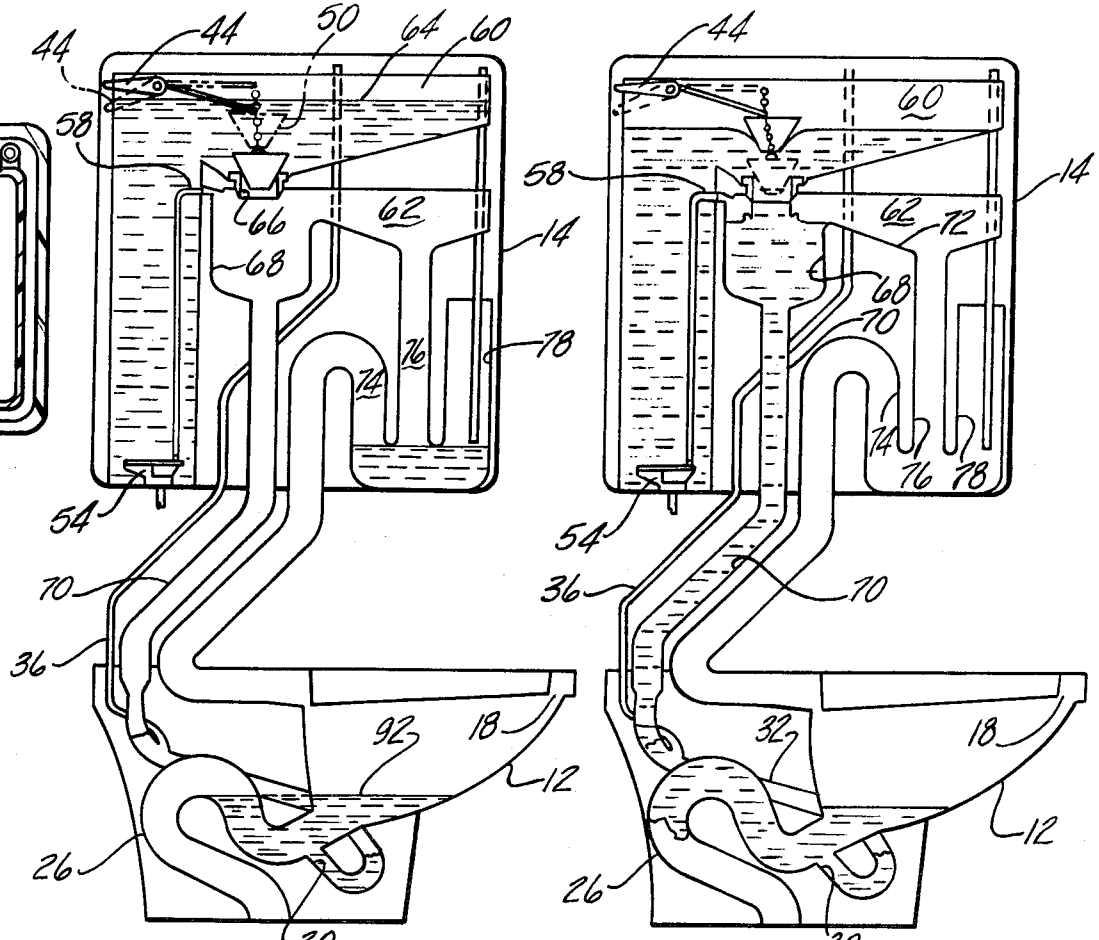
Fig-5
Fig-4
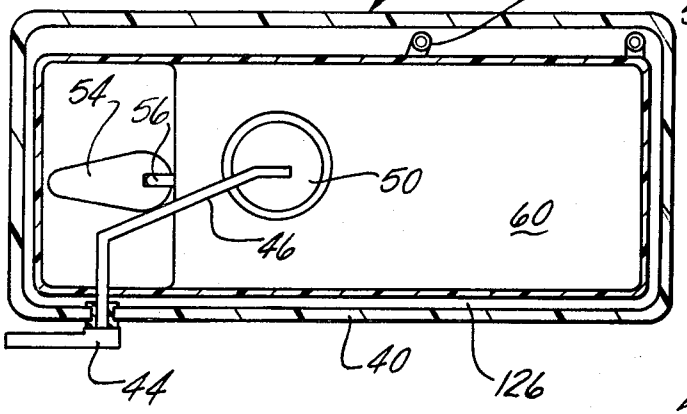
Fig-3

FLUSH APPARATUS FOR WATER CLOSET AND METHOD OF OPERATION

BACKGROUND OF THE INVENTION

This invention relates to the field of water closets and is particularly concerned with apparatus and a method for conservation of water during the flushing cycle.

It is known in the prior art to conserve water by evacuating the waste water from the bowl in such a manner that there is a minimum mix of the introduced rinse water with the waste water that is evacuated, thereby minimizing the loss of the introduced water into the drainage system. This has been done in the past in flush systems in which a partial vacuum is introduced into the drainage trap of the toilet to initiate siphoning of the waste water from the toilet bowl after which the rinse water can be introduced. Systems of this type are shown for example in U.S. Pat. No. 210,003, patented Nov. 19, 1878 in the name of Bunting, Jr., and U.S. Pat. No. 4,115,883, patented Sept. 26, 1978 in the name of Dauvergne. Apparatus of this type shown in these patents have drawbacks in that they require check valves in the trap to prevent return flow of gases or liquids from the sewer line. Further, they require other actuating or control apparatus which may become faulty during operation and are more costly to produce.

Other approaches have also been made in an effort to reduce the volume of flush water that is required. One such approach is disclosed in U.S. Pat. No. 3,843,978, patented Oct. 29, 1974 in the name of Ragot, wherein electrically operated switches operate a high-pressure water jet in the trap to initiate the flushing action and a high-pressure water jet in the bowl to generate swirling, scouring effect. Electrical sensors are required to regulate and control the jets and refill. Again, complex and costly apparatus is required for toilets of this type.

Still another approach is disclosed in U.S. Pat. No. 3,984,878, patented Oct. 12, 1976 in the name of Grasseschi wherein the flushing operation includes a high-pressure stream that occurs in two phases, a first phase which has high momentum and evacuates the bowl, and a second phase which has low momentum and refills and reseals the bowl. Again, this apparatus is complex and costly.

It is also known in the art to utilize a flushing system wherein a jet of water is utilized to initially evacuate the bowl, and rinse water, which flows in a parallel path, is used for rinsing the bowl. A system such as this is shown in U.S. Pat. No. 3,010,115, patented Nov. 28, 1961 in the name of Wiggs. However, in this flushing system there is no timing of flow or metering of any significant consequence that will reduce to a minimum the amount of flush water that is utilized so that optimum conservation can be realized.

Thus, the prior art structures fail to disclose a simple form of flush system which can use conventional toilet tank fill valves and flush handle and flush ball mechanisms and still provide maximum conservation of flush water without the need of adding expensive and complex additional valving and control mechanisms therefor. It is known to use tank fill valves that employ the hydraulic forces of the supply water to provide positive opening and closing of the valve. Valves of this type can be used in the present invention and are shown, for example, in U.S. Pat. No. 3,895,645, patented July 22, 1975; U.S. Pat. No. 4,065,095, patented Dec. 27, 1977; and U.S. Pat. No. 4,180,096, patented Dec. 25, 1979, in the name of Johnson.

SUMMARY OF THE INVENTION

The present invention has overcome the inadequacies of the prior art and can use conventional tank fill valves and flush lever mechanisms, and it can be flushed in a manner so that the standing pool of water and waste material in the bowl can be evacuated effectively, and thereafter rinse water can be introduced into the bowl so that minimum mixing of the rinse water with the waste material occurs. Then the required amount of standing water in the bowl can be introduced. This can be carried out in a most effective manner without the necessity for special valve components or other costly mechanisms which may become faulty in operation, and the system can be adjusted so that the minimum amount of water required per flush will be used.

According to one form of the present invention, a water closet is provided which comprises a bowl with an outlet in the bottom thereof, a trapway connected to the outlet of the bowl so as to provide a weirlevel at the elevation required to maintain a selected water level in the bowl, a siphon jet arranged to discharge water into the trapway adjacent to the bowl outlet to initiate siphoning of water from the bowl, and flush apparatus for discharging flush water to the bowl and to the siphon jet, characterized in that the flush apparatus includes a first means to measure and discharge initially a first metered quantity of water through the siphon jet sufficient to initiate siphoning of water and waste contents from the bowl, and second means to discharge a second metered quantity of water to the bowl for rinsing the bowl, said second means being responsive to operation of said first means to discharge the second metered quantity of water to the bowl in timed-delay relation so that the major portion of the water and waste contents have been siphoned from the bowl when the rinse water flows into the bowl.

In a preferred form, the flush apparatus includes a flush water tank having an upper compartment, a lower compartment, and a flush mechanism for releasing flush water from the upper compartment to the lower compartment, said lower compartment having a siphon jet metering chamber in communication with the siphon jet and a bowl rinse delay chamber in communication with the flush nozzle of the bowl, the metering and delay chambers being arranged to receive water released from the upper compartment, the bowl rinse delay chamber communicating with the flush nozzle through a siphon arranged so that flow of water to the flush nozzle cannot occur until after a timed-delay has occurred, corresponding to the time required to fill the rinse delay chamber to the flow level of the siphon therein. Thus, this form of the invention measures the necessary quantities of water for flow through the siphon jet and also for flow to the bowl for rinse purposes, and automatically provides the necessary time delay for flow of the water to the bowl after the evacuation has been initiated. In this form of the invention, an accumulator chamber can be utilized in conjunction with the rinse delay chamber, the accumulator chamber having an effective volume that can be selectively varied for setting the amount of water that will be metered through the rinse delay chamber.

Thus, a method of flushing the water closet is provided which comprises steps of introducing a jet of water into the trapway sufficient to initiate evacuation of the pool of water and waste materials in the bowl, and as an incident to introducing a jet of water into the trapway, rinse water is discharged into the bowl in a timed-delay relation after the evacuation has been initiated but before it has been fully completed so that only minimal mixing of the rinse water with the pool of water and waste material can occur.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 3 is a horizontal section taken on the line 3—3 of FIG. 2;

FIGS. 4, 5, 6, 7 and 8 are schematic sectional views drawn to a reduced scale and similar to FIG. 2, showing sequentially different stages of operation of the flush cycle;

and

Figure 9:
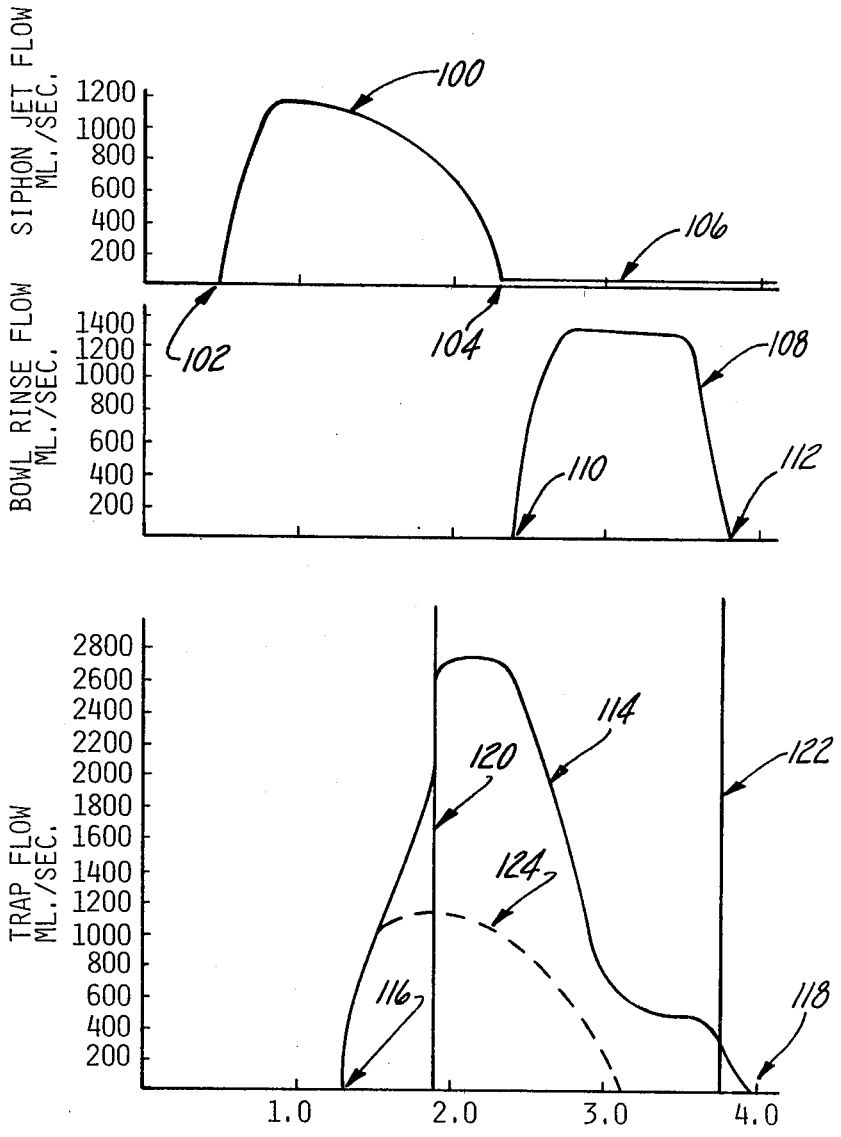

FIG. 9 is a graph showing the flow characteristics of the water through the trap, to the bowl, and to the siphon jet, setting forth the time relationship and volume of flow that can occur in one embodiment of the invention.

DESCRIPTION OF THE PREFERRED EMBODIMENTS

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The water closet 10 includes a bowl 12 and a flush water tank 14. The bowl 12 has an outlet 16 at the bottom thereof and an inlet flush nozzle 18 that extends around the upper periphery. The flush nozzle 18 can be any conventional type of nozzle for discharging rinse water into the bowl 12. An inlet port 20 is provided in the top wall 22 of the bowl 12 for receiving rinse water from the flush tank 14 for delivery via the passageway 24 to the flush nozzle 18. A trapway 26 is connected in sealed relation at 28 to the outlet 16 for discharge of the water and waste material from the bowl 12. The trapway 26 provides a weir 28 for establishing a desired weirlevel that will determine the level of the pool of water in the bowl 12. The trapway 26 has a siphon jet 30 arranged to discharge water into the trapway adjacent to the bowl outlet 16 to initiate siphoning of the water from the bowl. Water is directed to the siphon jet 30 by the passageway 32 which communicates with the inlet port 34 in the top wall 22 of the toilet bowl 12. The passageway 32 also has an air vent tube 36 which extends upwardly through the water tank 14 and has an upper end 38 open to the atmosphere within the confines of the flush tank 14 for venting purposes as will subsequently be described.

The flush tank 14 has an outer housing 40 that includes a removable cover 42. A conventional flush handle or lever 44 is mounted on the front side wall of the housing 40 and has a lever arm 46 connected thereto which has at its free end a chain 48 that supports a conventional flush ball 50. A pressurized water supply conduit 52 extends through the bottom wall of the housing 40 and is connected to the conventional water inlet or fill valve 54. The conventional tank inlet fill valve 54 uses the hydraulic force of the supply water to provide positive opening and closing of the main valve therein. This fill valve measures the water level by means of a diaphram that responds to water head. The diaphram movement drives a main valve which controls the flow of water into the tank. This valve is conventional in construction and can be constructed according to the teachings of any of the previously cited U.S. Pat. Nos. 3,895,654; 4,065,095 and 4,180,096 to which reference is made for a more detailed description of the valve. The main function of the valve is to control the supply of water to the tank. Another of the functions of the valve 54 is to provide water for the bowl refill passage of the flush tank. For this purpose a refill tube 56 leads to the bypass water inlet means 58, the purpose of which will subsequently be described. When the valve 54 is opened, water flows at a low rate through the tube 56 to the outlet of the bypass water outlet means 58.

The flush water tank 14 includes the upper compartment 60 and the lower compartment 62. The tank fill valve 54 is mounted within the confines of the upper compartment 60 for filling this compartment to the water level 64, as can be seen in FIG. 4. The water in the upper portion of the compartment 60 can be discharged into the lower compartment 62 when the flush ball 50 is raised by actuation of the flush lever 44 to the position shown in broken lines in FIG. 4. This will serve to open the discharge port 66. Thus, actuation of the flush mechanism 44, 46, 48 and 50 will result in releasing flush water from the upper compartment 60 for flow to the lower compartment 62.

The lower compartment 62 has first means 67 to measure and discharge initially a first metered quantity of water through the siphon jet 30 sufficient to initiate siphoning of water and waste contents from the bowl 12. This first means 67 includes a siphon jet metering chamber 68 which has a restricted passageway 70 that is in communication with the passageway 32 that terminates at the siphon jet 30.

The lower compartment 62 also has a second means 71 to discharge a second metered quantity of water to said bowl 12 for rinsing the bowl, said second means 71 being responsive to operation of said first means 67 to discharge the second metered quantity of water to the bowl 12 in timed-delay relation so that the major portion of the water and waste contents have been siphoned from said bowl 12 when the rinse water flows into the bowl 12. This second means 71 includes a bowl rinse delay chamber 72 which has an outlet portion 74 that defines a siphon, an inlet portion 76 and an accumulator portion 78. Water cannot leave the bowl rinse delay chamber 72 until the water has reached the level of the weir at 80 in the outlet portion 74. When siphon action commences, water will be removed from the bowl rinse delay chamber 72 and delivered to the flush nozzle 18 until the level of the water in the bowl rinse delay chamber 72 falls below the level at 82 in the chamber 72. Because of the aperture 84 in the top wall of the lower compartment 62, siphoning action will be interrupted when the level of the water recedes below point 82.

Figures 1, 2:
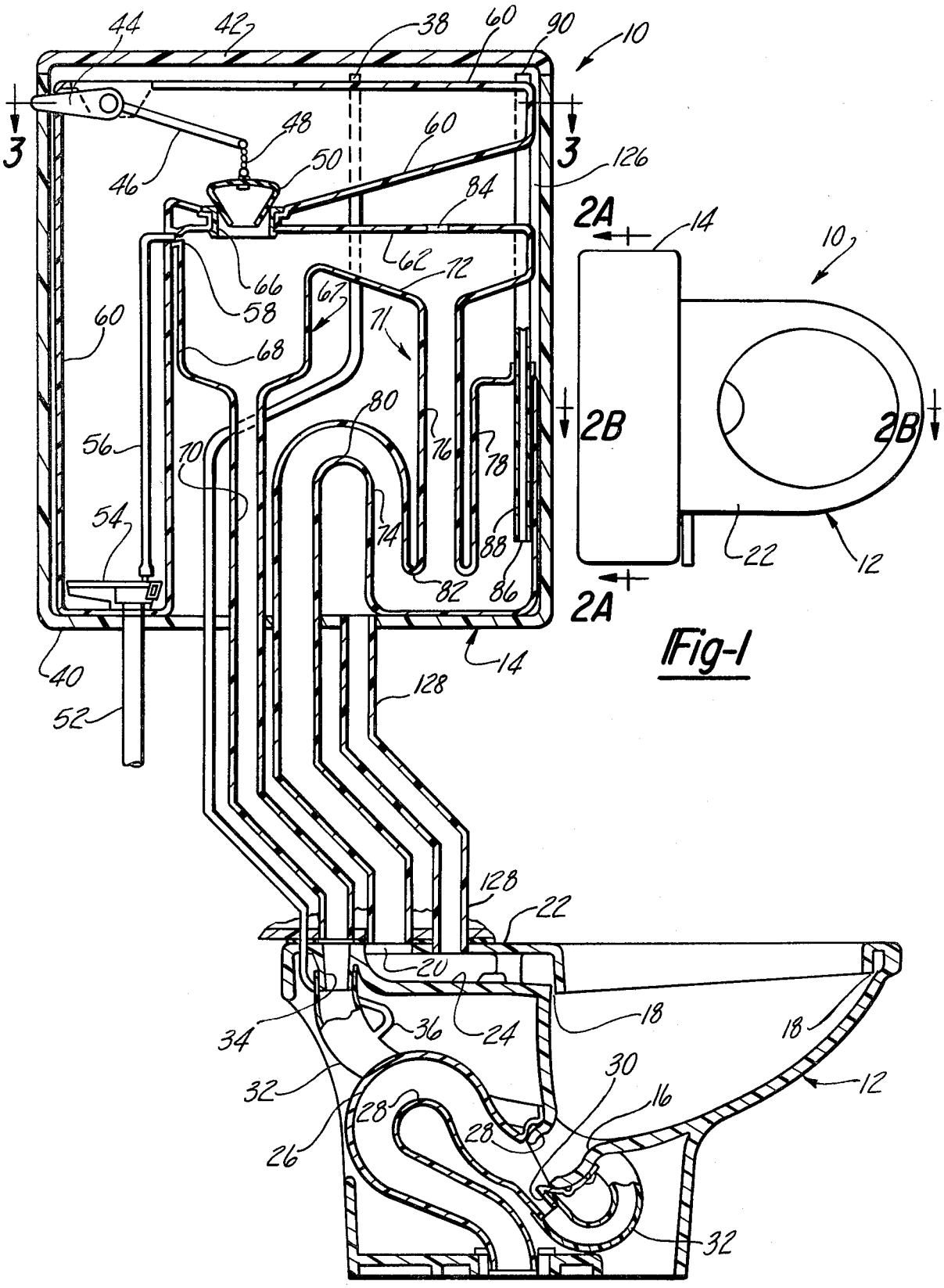
FIG. 1 is a top plan view of a water closet with a flush tank and toilet bowl embodying one form of the present invention.
FIG. 2 is an enlarged schematic sectional view showing a vertical section of the flush tank taken on the line 2A—2A of FIG. 1, and a vertical section of the toilet bowl taken on the line 2B—2B of FIG. 1, the sections being at right angles for purposes of illustration.

The quantity of water that can be discharged from the bowl rinse delay chamber 72 can be regulated during initial installation by setting the elevation of the lower end 86 of the vent tube 88 at a selected level during installation and the upper end can then be cut to the proper length. As can be seen in FIG. 2, the vent tube 88 has its upper end 90 open to atmosphere, and under these conditions, the level of the water in the accumulator portion 78 can rise freely until the lower end 86 of the tube 88 is covered. Thereafter, air is trapped in the accumulator portion 78 and only a limited amount of water can thereafter enter the chamber to an extent corresponding to the amount of pressure exerted upon the air within the accumulator portion 78. Once this level has been reached, water then can rise more rapidly in the outlet portion 74, and when siphoning does commence, a volume of water will be discharged to the bowl 12 for rinse purposes.

Referring now to FIGS. 4–8, inclusive, the sequence of operation that occurs during flushing will now be described. FIG. 4 shows the water closet with a normal level of water at 92 in the bowl 12 and with the water in the upper compartment 60 at the level 64. The flush lever 44 is now depressed to the broken line position causing the flush ball 50 to be elevated, as shown.

FIG. 5 shows the flush ball 50 raised to the elevated position and the water has begun to fall from the upper compartment 60 into the siphon jet metering chamber 68 filling the latter and its restricted discharge passageway 70, passageway 32, and initiating flow of water through the trapway 26. At the outset of this step of operation, air that otherwise would be trapped in the passageway 70 can flow upwardly through the vent tube 36.

Figure 6:
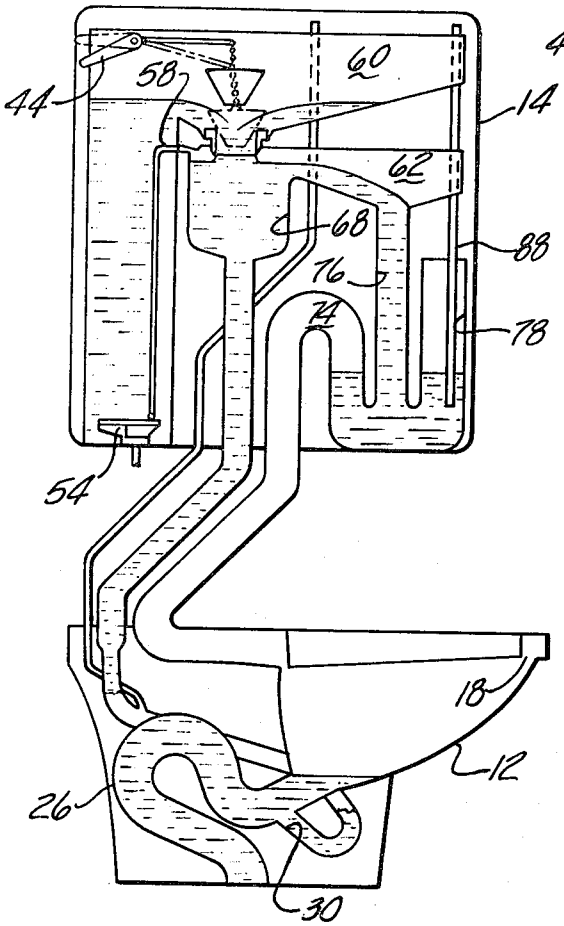

FIG. 6 illustrates the flushing operation at the time when the siphon jet supply chamber 68 overflows into the bowl rinse chamber 62. The bowl rinse chamber 62 now fills, raising the water level in the outlet portion 74, inlet portion 76 and accumulator portion 78. When the level reaches the bottom of the adjustment tube 88, an air pocket is formed and the level of the outlet portion 74 now rises faster.

Figure 7:
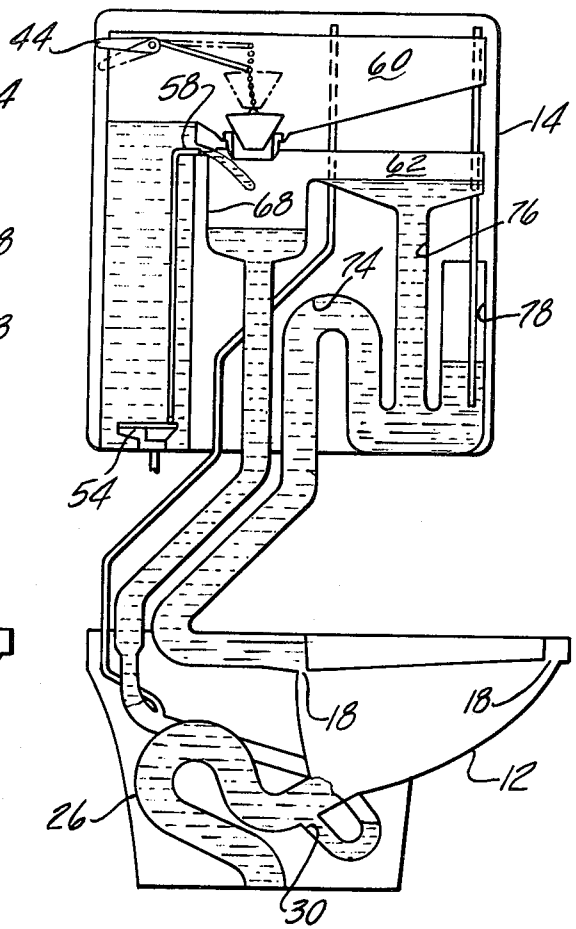

Referring now to FIG. 7, the outlet portion 74 has now become filled and a siphon action has been initiated leading to a bowl rinse being started. The arrival of the bowl rinse water at the flush nozzle 18 is delayed-timed so as to just maintain the siphonic action with the water in the bowl 12 at the lowest possible level. In this way, the least amount of flush water is used. As can be seen in FIG. 7, the vacuum has not yet been broken in the trapway 26.

Figure 8:
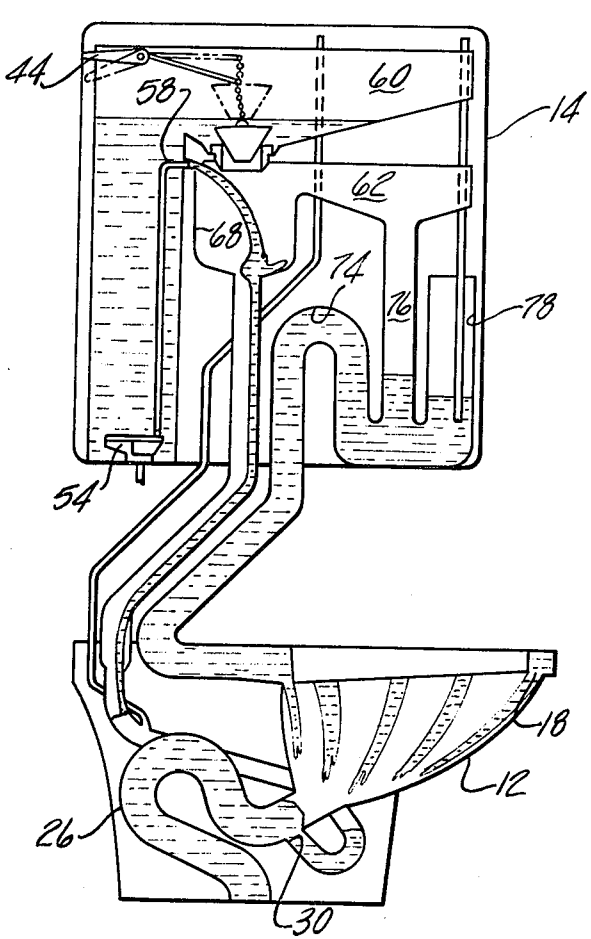

Referring now to FIG. 8, as the bowl rinse continues, the upper compartment 60 is beginning to refill by operation of the valve 54. The bypass means 58 has been functioning to allow a small quantity of water to flow through the siphon jet metering chamber 68 so that as soon as the level of the water in the upper compartment 60 has reached that shown in FIG. 4, the balance of the water from the siphon jet metering chamber will restore the level of the water in the bowl 12 to that which is also shown at 92 in FIG. 4.

Thus, it can be seen that the flush cycle can be carried out in a completely noiseless manner without using any movable mechanical parts other than the conventional inlet fill valve and flush lever mechanism, and the amount of flush water used can be maintained at an absolute minimum so that the water that flows to the toilet bowl 12 functions merely to displace the water and waste material in the bowl without significantly mixing the rinse water with the water discharged through the trap 26.

The flush apparatus described above can be used in conjunction with a water closet of conventional size having the capacity for using a minimum of at least 13,247.5 ml. (3½ gals) per flush, but can perform the flushing operation utilizing only approximately 3425 ml., or approximately only one-quarter that of a conventional water closet. The flushing operation can be carried out noiselessly in about four seconds.

Referring to FIG. 9, a brief description will be given of the flow characteristics of such a water closet embodying the described invention. Initially, the volume of standing water in bowl 12 equals 1600 ml. The flush lever 44 has been depressed at the time "0", and approximately one-half second elapses before the water siphon jet flow commenses at the siphon jet 30. The quantity of flow that then flows through the siphon jet 30 totals 1500 ml. as reflected by the area under line 100 and the flow continues for approximately 1.9 seconds from the point in time at 102 to the point in time at 104. Thereafter, water will continue to flow from the by-pass means 58 as represented by the line 106 in an amount equal to about 325 ml.

The flow of water from the bowl rinse delay chamber 62 into the bowl 12 is indicated by the line 108 showing that the flow into the bowl commences from the point in time at 110 and continues to the point in time at 112. The quantity of water that flows to the bowl 12 is 1600 ml. as reflected by the area under line 108. Thus, the total flow of water from the tank 14 will equal 1500 ml., plus 325 ml., plus 1600 ml. or a total of 3425 ml.

The sum of flow from the tank 14 is equal to that which flows through the trap 26 and this quantity is indicated by the area under the line 114. The flow of water through trap 26 commences from the point in time at 116 and continues to the point in time 118. The siphon action in the trap 26 starts at the point in time indicated by the line 120 and stops at the point in time indicated by the line 122. Broken line 124 reflects the quantity of water corresponding to the area under line 100 which flows through the siphon jet 30 for starting the siphon action. Thus, the quantity of flow of water through the trap 26 includes 1500 ml. from siphon jet 30, 1600 ml. from the standing pool in the bowl 12 and 325 ml. from the by-pass means 58, again equalling 3425 ml.

In the described embodiment, the time-delay provided for introducing the rinse water from the second means 71 after the siphon jet flow water has been introduced from the first means 67 is approximately 1.9 seconds and the delay resulting from this time of flow to the trap 26 is approximately 0.8 seconds, as indicated, for example, by the shift to the right in FIG. 9 of the siphon jet flow under lines 100 and 124.

Another feature of the invention is the leakage passageways, such as at 126, FIG. 3, that are present between the housing 40 and the molded members 60 and 62 to allow any overflow that inadvertently may occur, to flow down to the overflow passageways 128 (see FIG. 2) and then into the bowl 12. As noted above in the Brief Description of the Drawings, FIG. 2 is intended to be of a schematic nature to illustrate principles of the invention, and hence it will be appreciated that such is the illustration of the various conduits between the tank and bowl.

What is claimed:

1. A water closet comprising a bowl with an outlet in the bottom thereof, a trapway connected to the outlet of said bowl so as to provide a weirlevel at an elevation sufficient to maintain a selected water level in said bowl, a siphon jet arranged to discharge water into said trapway adjacent to said bowl outlet to initiate siphoning of water from said bowl, and flush apparatus for discharging flush water to said bowl and to said siphon jet, characterized in that said flush apparatus includes first means to measure and discharge initially a first metered quantity of water through said siphon jet sufficient to initiate siphoning of water and waste contents from said bowl, and second means to discharge a second metered quantity of water to said bowl for rinsing the bowl, said second means being reponsive to operation of said first means to discharge the second metered quantity of water to the bowl in timed-delay relation so that the major portion of the water and waste contents have been siphoned from said bowl when the rinse water flows into the bowl, said second means comprising chamber structure which begins to accumulate water in response to operation of said first means and which begins to discharge said second metered quantity of water after a predetermined accumulation.

2. A water closet according to claim 1, characterized in that adjustment means are associated with said second means for selectively setting the effective volume of said second metered quantity of water.

3. A water closet according to claim 1, characterized in that a by-pass water inlet means is associated with said first means, and after the siphoning action of the water from said bowl has been terminated by lowering of the water level in said bowl a sufficient amount, said by-pass water inlet means is operable to supply a limited quantity of water through said first means for refilling the bottom of said bowl to said weirlevel.

4. A water closet according to claim 1, characterized in that said flush apparatus has a vent means to atmosphere above said first and second means in communication with said siphon jet at an elevation immediately above said trapway for venting air from said first means during passage of said first metered quantity of water to said siphon jet.

5. A water closet comprising a bowl with an outlet in the bottom thereof and a flush nozzle for bowl rinse purposes adjacent to the top thereof, a trapway connected to the outlet of said bowl so as to provide a weirlevel at an elevation sufficient to maintain a selected water level in said bowl, a siphon jet arranged to discharge water into said trapway adjacent to said bowl outlet to initiate siphoning of water from said bowl, and flush apparatus for discharging flush water to said bowl and to said siphon jet, characterized in that said flush apparatus includes a flush water tank having an upper compartment, a lower compartment, and a flush mechanism for releasing flush water from said upper compartment to said lower compartment, said lower compartment having a siphon jet metering chamber in communication with said siphon jet and a bowl rinse delay chamber in communication with said flush nozzle, said metering and delay chambers being arranged to receive water released from said upper compartment, said bowl rinse delay chamber communicating with said flush nozzle through a siphon arranged so that the flow of water to the flush nozzle cannot occur until after a time delay has occurred corresponding to the time required to fill the rinse delay chamber to the flow level of the siphon therein.

6. A water closet according to claim 5, characterized in that said metering chamber is located relative to said rinse delay chamber so that overflow water from the metering chamber can flow to said rinse delay chamber, and the communication between said metering chamber and the outlet of said siphon jet is restricted so that the rinse delay chamber can fill to the flow level of the siphon therein while the trap siphon begins evacuation of said bowl.

7. A water closet according to claim 6, characterized in that said bowl rinse chamber has an outlet portion defining the siphon therein, and inlet portion for receiving the overflow water from said metering chamber, and an accumulator portion in which water received by the bowl rinse chamber can enter, and an adjustment tube vented at the upper end to atmosphere extending downwardly into said accumultor chamber a selected distance so that when the level of the water entering the accumulator portion covers the bottom of the tube an air pocket is formed thereabove and the level of the water in the outlet portion rises faster.

8. A water closet according to claim 5, characterized in that said flush water tank includes an exterior housing, and said upper compartment and said lower compartment are thermoplastic molded members inserted in said housing.

9. A water closet according to claim 8, characterized in that said exterior housing has at least one leakage passageway which communicates with said bowl via at least one passageway between said housing and said bowl for flow of overflow water from said members.

10. A toilet comprising a bowl, an outlet from said bowl, a rinse inlet to said bowl via which liquid may be introduced to rinse said bowl, a trapway at said outlet of said bowl constructed and arranged so as to provide a weirlevel at an elevation sufficient to maintain a selected liquid level in said bowl, and flush apparatus associated with said trapway and said rinse inlet, said flush apparatus comprising first means to introduce liquid into said trapway to initiate siphoning of liquid from said bowl and second means to introduce liquid into said bowl via said rinse inlet in time delayed relation to the initiation of siphoning of liquid from said bowl, said second means comprising chamber structure which begins to accumulate liquid in response to operation of said first means and begins to discharge liquid into said bowl via said rinse inlet after a predetermined accumulation of liquid by said chamber structure.

11. For use with a toilet comprising a bowl, an outlet from said bowl, a rinse inlet to said bowl via which liquid may be introduced to rinse said bowl, a trapway at said outlet of said bowl constructed and arranged so as to provide a weirlevel at an elevation sufficient to maintain a selected liquid level in said bowl, and flush apparatus associated with said trapway and said rinse inlet and operable to introduce liquid into said trapway to initiate siphoning of liquid from said bowl and to introduce liquid into said bowl via said rinse inlet in timed-delay relation to the initiation of siphoning of liquid from said bowl, a chamber structure comprising an upper compartment and a lower compartment, said upper compartment serving to contain liquid for use by said lower compartment during a flushing operation, said lower compartment comprising first chamber means for receiving liquid from said upper compartment during a flushing operation and conveying same to said trapway so as to initiate siphoning os said liquid from said bowl and second chamber means for receiving liquid from said upper compartment during a flushing operation, said second chamber communicating with said rinse inlet and comprising a siphon arranged so that flow of liquid to said rinse inlet cannot occur until after a time delay has occured corresponding to the time required to fill said second chamber means to the flow level of the siphon thereof.

* * * * *